US009556735B2

(12) United States Patent
Ryyppo

(10) Patent No.: US 9,556,735 B2
(45) Date of Patent: Jan. 31, 2017

(54) RADIAL PISTON HYDRAULIC MOTOR

(71) Applicant: Sampo-Hydraulics Oy, Jyska (FI)

(72) Inventor: Roni Ryyppo, Jyväskylä (FI)

(73) Assignee: SAMPO-HYDRAULICS OY (FI)

( * ) Notice: Subject to any disclaimer, the term of this patent is extended or adjusted under 35 U.S.C. 154(b) by 315 days.

(21) Appl. No.: 14/245,664

(22) Filed: Apr. 4, 2014

(65) Prior Publication Data

US 2014/0298982 A1 Oct. 9, 2014

(30) Foreign Application Priority Data

Apr. 5, 2013 (FI) ..... 20135328

(51) Int. Cl.
*F01B 1/06* (2006.01)
*F04B 1/04* (2006.01)
(Continued)

(52) U.S. Cl.
CPC ..... *F01B 1/06* (2013.01); *F01B 1/0603* (2013.01); *F01B 1/0665* (2013.01); *F03C 1/047* (2013.01);
(Continued)

(58) Field of Classification Search
CPC ..... F01B 1/0665; F01B 31/24; F01B 31/22; F03C 1/0425
(Continued)

(56) References Cited

U.S. PATENT DOCUMENTS 3,893,572 A * 7/1975 Axelsson ..... B66D 1/08 212/196
3,981,374 A * 9/1976 Johns, Jr. ..... B62D 59/04 180/14.3
(Continued)

FOREIGN PATENT DOCUMENTS

FI 20030484 4/2003

OTHER PUBLICATIONS

Finnish Search Report dated Feb. 3, 2014 for Application No. 20135328.
(Continued)

*Primary Examiner* — Thomas E Lazo
(74) *Attorney, Agent, or Firm* — Andrus Intellecutal Property Law, LLP

(57) ABSTRACT

The invention relates to a radial piston hydraulic motor. The radial piston hydraulic motor comprises a cam ring provided, with a wave-shaped inner surface and radial cylinders provided in the inner part inside the cam ring and pistons that move therein as well as rollers coupled to the pistons so as to follow the inner surface of the cam ring. By the effect of the working pressure of hydraulic oil conveyed to the cylinders, the rollers that are pressed against the inner surface of the cam ring provide a rotating movement of the cam ring and the inner part relative to each other. The hydraulic motor is provided with disengaging members disengaging the rollers coupled to the pistons from contact to the inner surface of the cam ring when the working
(Continued)

pressure stops acting in the cylinders for bringing the hydraulic motor into freewheeling. The hydraulic motor is provided with a control coupling which, when the prevailing pressure of hydraulic oil in the working pressure line that leads to the cylinders drops below a specific level, automatically disengages the cylinders from the working pressure line and couples the hydraulic motor into freewheeling.

19 Claims, 4 Drawing Sheets

(51) Int. Cl.

| | |
|---|---|
| ***F04B 1/047*** | (2006.01) |
| ***F03C 1/04*** | (2006.01) |
| ***F03C 1/047*** | (2006.01) |
| *F01B 9/06* | (2006.01) |

(52) U.S. Cl.
CPC ..... *F03C 1/0425* (2013.01); *F04B 1/047* (2013.01); *F04B 1/0435* (2013.01); *F01B 9/06* (2013.01)

(58) Field of Classification Search
USPC ..... 91/491
See application file for complete search history.

(56) References Cited

U.S. PATENT DOCUMENTS

| | | | | |
|---|---|---|---|---|
| 5,224,411 | A | 7/1993 | Fillion | |
| 5,682,958 | A * | 11/1997 | Kalhorn | B60K 17/10 180/14.3 |
| 5,836,231 | A * | 11/1998 | Leinonen | F01B 1/0603 91/491 |
| 6,145,312 | A * | 11/2000 | Hauser | F16H 61/40 60/464 |
| 6,508,328 | B1 * | 1/2003 | Kenyon | F16H 61/44 180/305 |
| 7,225,720 | B2 * | 6/2007 | Lampinen | F03C 1/0425 91/473 |

OTHER PUBLICATIONS

English language translation of Abstract for DE19580685 dated Oct. 12, 2006.
English language translation of Abstract for DE1102012009794 dated Nov. 29, 2012.
English language Patent Abstract of Japanese H11236869 dated Aug. 31, 1999.
English language translation of Abstract for FR2853364.

* cited by examiner

RADIAL PISTON HYDRAULIC MOTOR

CROSS REFERENCE TO RELATED APPLICATION

The present application claims priority of Finnish Patent Application No. 20135328, filed Apr. 5, 2013, the contents of which is incorporated herein by reference in its entirety.

TECHNICAL FIELD

The invention relates to a radial piston hydraulic motor that couples into freewheeling, so that the motor can be freely driven in a freewheeling state irrespective of whether a hydraulic medium, supplied to the motor be available or not. In more detail, the radial piston hydraulic motor comprises a cam ring provided with a wave-shaped inner surface and radial cylinders disposed in the inner part inside the cam ring, and pistons that move in the cylinders as well as rollers coupled to the pistons so as to follow the inner surface of the cam ring in order that, by the effect of the working pressure of hydraulic oil conveyed to the cylinders, the rollers that are pressed against the inner surface of the cam ring provide a rotating movement of the cam ring and the inner part relative to each other, and which hydraulic motor is provided with disengaging members for disengaging the rollers coupled to the pistons from contact to the inner surface of the cam ring when the working pressure stops acting in the cylinders in order to bring the hydraulic motor into freewheeling.

TECHNICAL BACKGROUND

Cam ring motors, i.e. radial piston hydraulic motors provided with a cam ring, have been known for quite some time. In such a motor, radial pistons are provided with rollers that are pressed against a wave-shaped inner surface of the cam ring. It is characteristic of the motor that a specific supply pressure must be constantly available so that the rollers of the pistons stay engaged to the wave-shaped cam ring. As the rotating speed of the motor rises, the output, i.e. volume flow, supplied by the pump is at some point no longer sufficient relative to the speed of the motor, in which case, without special arrangements, the rollers of the pistons start to disengage from the cam ring, the hydraulic motor starts to sound abnormal and is obviously at risk from breakage. In this situation, the motor must be couplable into freewheeling and, in addition, the motor must be structurally and functionally such that the pistons, especially the rollers of the pistons, automatically come off the cam ring. To this end, the motor must be provided with a special freewheeling valve. As one example of such a solution, a radial piston hydraulic motor and a method in the control thereof as described in FI patent publication No 118233 are disclosed.

Other state of the art solutions are also known. As one example, an arrangement described in U.S. Pat. No. 5,224,411 is disclosed, wherein two hydraulic motors are supplied by a hydraulic pump, one being continuously coupled to one pump and the other being disengageable from it. The motor that is disengageable is of a type where the pistons come off the cam ring when pressure is not supplied to the motor. The system comprises a check valve disposed in a distributor valve for preventing the cams from being struck against the cam ring when the cam ring starts to press them into the group so as to assume a freewheeling position. This is effected so that the check valve prevents the oil that has been discharged from under the pistons from flowing under the pistons that are already pressed into the block and lifting them back up. The only way for the oil is to the tank line. However, the control valve described in the patent referred to above does not function automatically but requires that the freewheeling position be manually switched on.

With respect to the state of the art, reference is also made to U.S. Pat. No. 6,508,328 describing a hydraulically operated working machine driving system. A by-pass valve is provided in connection, with the motor and disposed in a block external to the motor for preventing the hydraulic motor from cavitating and unnecessarily braking in a situation where the speed of the machine is high and the wheels rotate faster than the pump outputs oil. The machine has a mechanical main power transmission, so this possible. In this case, the valve connects lines A and B of the motor to each other so that the supply pressure acts under the pistons and the rollers of the piston follow the cam ring. When the speed of the wheels slows down to a degree that the output of the pump is sufficient again, this valve automatically couples the by-pass flow to the plug, a full supply pressure is conveyed to the pistons and the motor starts to drive again. However, the valve does not couple the pistons into freewheeling, i.e. into the cylinder block off the cam ring. The pistons continuously hold contact to the cam ring, and no real freewheeling is established. As the pistons follow the cam ring, power losses occur.

SUMMARY OF THE INVENTION

An invention has now been made so as to apply the coupling of a radial piston hydraulic motor into freewheeling automatically when the working pressure drops below a specific level for example as the speed of the motor rises. Freewheeling means that the motor may be freewheeled without energy loss or with substantially low energy loss or without overheating problems, even with high speeds.

A novel radial piston hydraulic motor has now been provided to be automatically coupled into freewheeling in a given situation, in which freewheeling state the motor can be rotated freely irrespective of whether a hydraulic medium supplied to the motor be available or not. To this end, the radial piston hydraulic motor is provided with a control coupling which, when the prevailing pressure of hydraulic oil in a working pressure line that leads to the cylinders drops below a specific level, automatically couples the cylinders off the working pressure line and the hydraulic motor into freewheeling.

In one embodiment, the control coupling comprises a first valve which is a pressure-controlled valve coupled to the working pressure line that leads to the cylinders of the hydraulic motor and to the return line provided from the cylinders, respectively, and controlled via the working pressure line so that, when the prevailing pressure of hydraulic oil in the working pressure line drops below a specific level, the first valve closes the working pressure line and the return line to the hydraulic motor. The first valve of the control coupling may be implemented in many different ways.

In one embodiment, the control coupling comprises a first valve which is a pressure-controlled valve coupled to the working pressure line that leads to the cylinders of the hydraulic motor and to the return line provided from the cylinders, respectively, and controlled via the working pressure line so that, when the prevailing pressure of hydraulic oil in the working pressure line drops below a specific level, the first valve closes the working pressure line and the return line to the hydraulic motor, in which case the hydraulic oil is conveyed from the working pressure line directly to the return line.

In one embodiment, the control coupling comprises a first valve coupled in a location corresponding to the above-mentioned embodiments. In this embodiment, when the prevailing pressure of hydraulic oil in the working pressure line drops below a specific level, the first valve closes the working pressure line and the return line to the hydraulic motor and to the first valve.

In one embodiment, the control coupling comprises a first valve coupled in a location corresponding to the above-mentioned embodiments. In addition, the working pressure line comprises an inlet line of the hydraulic motor provided between the first valve and the hydraulic motor and the return line comprises an outlet line of the hydraulic motor provided between the first valve and the hydraulic motor; when the prevailing pressure of hydraulic oil in the working pressure line drops below a specific level, the first valve closes the working pressure line and the return line to the first valve and connects the inlet line and the outlet line to each other through the first valve.

In one embodiment, the control coupling comprises a first valve coupled in a location corresponding to the above-mentioned embodiments. In addition, the working pressure line comprises an inlet line of the hydraulic motor provided between the first valve and the hydraulic motor and the return line comprises an outlet line of the hydraulic motor provided between the first valve and the hydraulic motor; when the prevailing pressure of hydraulic oil in the working pressure line drops below a specific level, the first valve closes the working pressure line and the return line to the hydraulic motor and connects the inlet line and the outlet line to each other through the first valve, in which case the hydraulic oil is conveyed from the working pressure line directly to the return line.

In one embodiment, the control coupling comprises a first valve coupled in a location corresponding to the above-mentioned embodiments. In addition, the working pressure line comprises an inlet line of the hydraulic motor provided between the first valve and the hydraulic motor and the return line comprises an outlet line of the hydraulic motor provided between the first valve and the hydraulic motor; when the prevailing pressure of hydraulic oil in the working pressure line drops below a specific level, the first valve closes the working pressure line to the hydraulic motor and connects the inlet line and the outlet line to the return line through the first valve.

In one embodiment, the control coupling comprises a first valve coupled in a location corresponding to the above-mentioned embodiments. In addition, the radial piston hydraulic motor comprises a case line of the hydraulic motor so that, when the prevailing pressure of hydraulic oil in the working pressure line drops below a specific level, the valve is arranged to connect, by means of hydraulic oil, the inlet line and the outlet line of the hydraulic motor to each other and to connect the inlet line and the outlet line to the case line of the hydraulic motor through the first valve. In this case, the hydraulic motor also comprises a drain line and a tank line, the case line being connected through the hydraulic motor to the drain line which is coupled to the tank line. Further in this embodiment, when the pressure of hydraulic oil in the working pressure line drops below a specific level, the first valve connects the working pressure line to the return line. In this embodiment, the releasing of pressure of hydraulic oil to the tank line may be accelerated.

In one embodiment, the control coupling comprises a first valve coupled in a location corresponding to the above-mentioned embodiment. In this embodiment, the first valve functions as explained in the preceding paragraph with the exception that, when the pressure of hydraulic oil in the working pressure line drops below a specific level, the first valve closes the working pressure line to the first valve. In this embodiment, too, the releasing of pressure of hydraulic oil to the tank line may be accelerated.

In all embodiments described above, a choke through which the first valve is controlled via the working pressure line can be provided in the control coupling. The purpose of the choke is to limit the amount of hydraulic oil supplied to the control pressure of the first valve and make a pushing of the first valve to its right extreme position smoother. A flow control valve, a narrow hydraulic control channel or another such structure may be used as the choke for limiting the amount of hydraulic oil supplied to the control pressure of the first valve from the working pressure line. If the first valve already has a built-in choke or the structure of the valve is provided such that the flow to the control pressure of the valve is limited, the choke is not necessary and can be left out from the hydraulic motor.

Said first valve may be a component internal or external to the hydraulic motor. Said choke may be a component internal or external to the hydraulic motor.

In one embodiment, the hydraulic motor further comprises a separately operated second valve coupled to the control pressure line that leads to the first valve for forcing into a working mode of the hydraulic motor that has been coupled or that is coupling into freewheeling irrespective of the rotating speed or working pressure.

Further in one embodiment, the hydraulic motor comprises a separately operated third valve coupled to the control pressure line of the first valve for forcing the hydraulic motor from a working mode into freewheeling irrespective of the rotating speed or working pressure. More precisely, in said embodiment the third valve is coupled to a part of the control pressure line provided between the control pressure coupling point in the first valve and the second valve.

In one embodiment, the above-described second valve and third valve can alternatively be combined into one valve, while obtaining in said combined valve the same operation as described above with reference to the second valve and the third valve, so it is not explained in any more detail herein.

The different embodiments of the radial piston hydraulic motor disclosed herein provide important advantages as compared to the known radial piston hydraulic motors. Automatic coupling of the hydraulic motor into freewheeling is particularly preferred in a situation where, as the motor is driving, the machine is started from a low speed while the hydraulic medium circulates through the motor. As the speed rises to a sufficient degree, at some point a situation is reached where the output flow of the pump relative to the speed of the motor is no longer sufficient, which results in a drop in the working pressure supplied to the motor. In this case, the motor automatically couples into freewheeling, so that the working pressure is no longer supplied to the motor. Further, the pistons of the motor come off the cam ring, so that the motor is freewheel able and the unnecessary risk of breakage of the motor is avoided or at least decreased.

The radial piston hydraulic motor is also well suited for use in apparatuses and machines which, in addition to the hydraulic motor, have another device assisting in the rotation of the hydraulic motor. Examples include working machines and vehicles where the front wheels are driven e.g. by a combustion engine and the rear wheels by a hydraulic motor or where e.g. a trailer of which the wheels or at least one axle are driven by a hydraulic motor is coupled to a diesel engine driven working machine. In such a combination, when the hydraulic pump that supplies pressure to the hydraulic motor can no longer supply a sufficient volume flow to provide the hydraulic motor with the required rotating speed accommodated to she speed of the vehicle or the working machine provided by the combustion engine, the pressure of the hydraulic motor is reduced, in which case it must be couplable into freewheeling to prevent breakage.

The radial piston hydraulic motor described above is not limited merely to the above-described radial piston hydraulic motor structure, but is also applicable to other similar types of radial piston hydraulic motor structures wherein the above-described type of freewheeling may be implemented according to the structures described in the invention.

The above-described one or more embodiments of the hydraulic motor with the control coupling allow important advantages as compared to the existing solutions. The hydraulic motor automatically couples into freewheeling, which enables the prevention, in certain disadvantageous situations exemplified above, of breakage of the motor or its premature wearing or at least decrease the risk of breakage or premature wearing. In freewheeling the motor wheels without substantial energy loss and may not have overheating problems even when the motor speed is substantially high. In normal use, these situations may be quite often encountered. The hydraulic motor may also be forced into freewheeling or out of freewheeling irrespective of the situation of use or of the pressure prevailing in the hydraulic motor in that situation or of the volume flow supplied therein. This additional feature may increase the properties and functionality of the motor even further. The control coupling may be implemented with a simple structure which may allow savings in the manufacturing costs for the motor. The above-described arrangement may also enable the integration of some or all structural parts such as valves into the motor as a single functional assembly and thus may reduce e.g. the number of connectors and other pipe parts while reducing any potential leakage points in the motor.

Other advantages and characteristics of the invention are disclosed in the description below where the hydraulic motor and its control are described with reference to the accompanying exemplary figures; the radial piston hydraulic motor is not to be limited to any detail of the figures, which merely illustrate different embodiments of the hydraulic motor.

Figure 1:
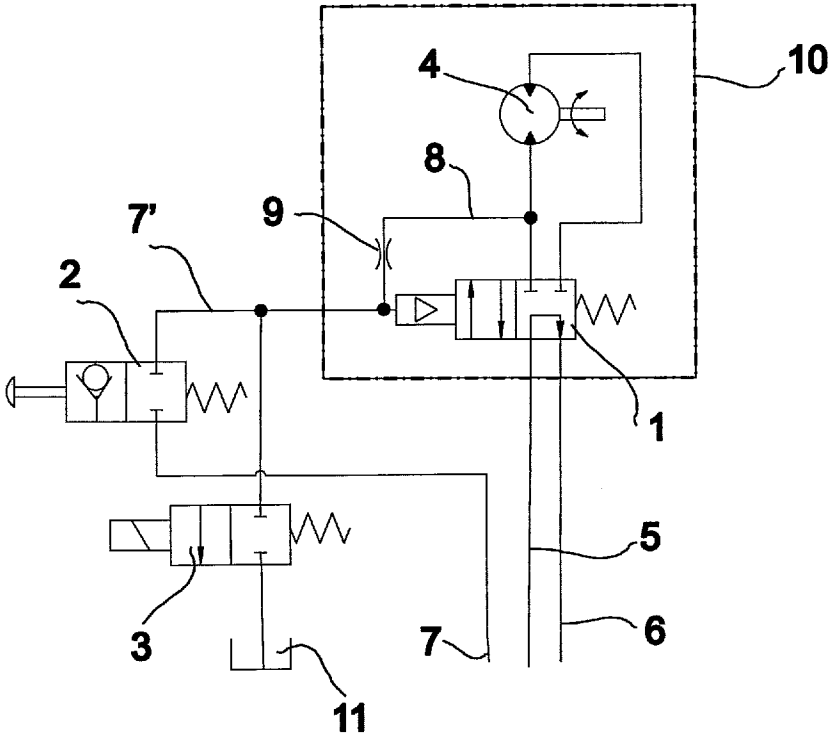
FIG. 1 is a simplified hydraulic schematic of the radial piston hydraulic motor with the control coupling.
Figure 5:
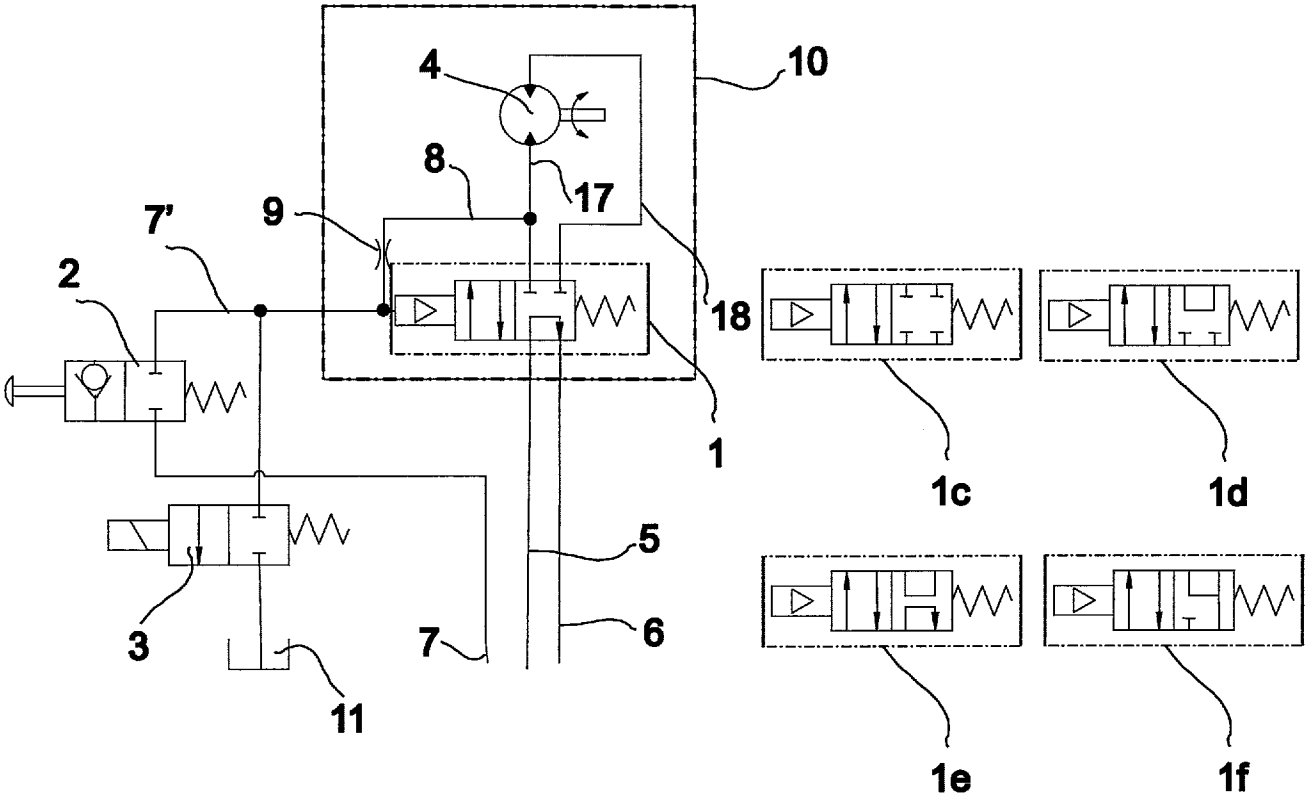

The simplified hydraulic schematic of FIG. 5 illustrating the radial piston hydraulic motor shows alternative solutions to the first valve of the simplified hydraulic schematic shown in FIG. 1.

DETAILED DESCRIPTION OF THE PREFERRED EMBODIMENTS

In the accompanying figures, similar components are referred to by the same numbers.

Figure 3:
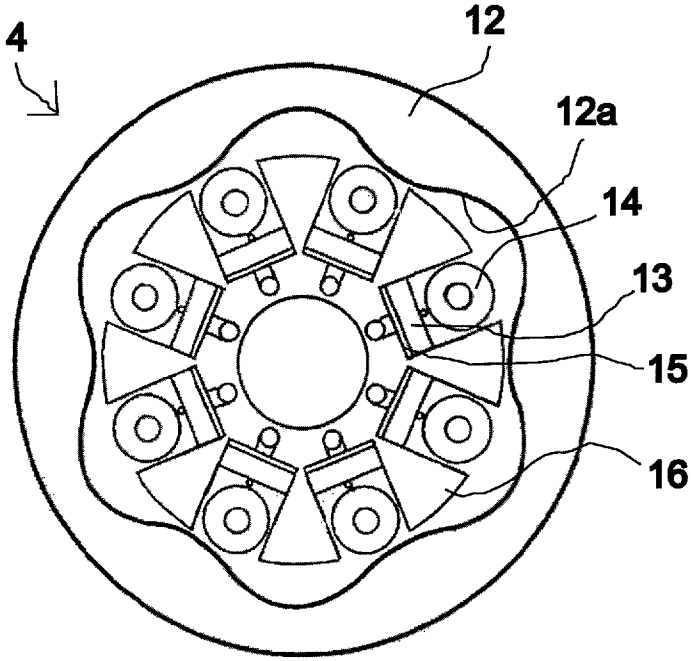
FIG. 3 shows the freewheeling motor corresponding to FIG. 2 in a freewheeling state.
Figure 2:
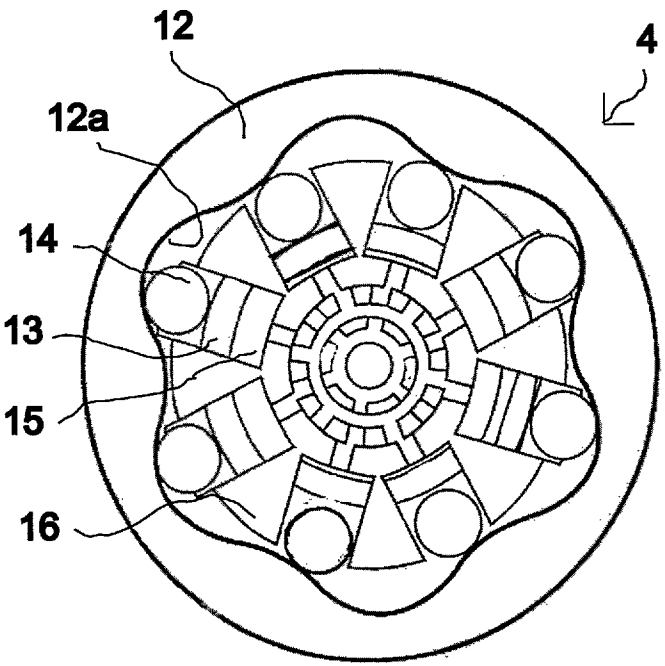
FIG. 2 shows a simplified sectional view of the freewheeling motor in a working state.

FIG. 1 shows a simplified hydraulic schematic of a hydraulic motor 4 with a control coupling. The hydraulic motor 4 is a cam ring motor as illustrated in FIGS. 2 and 3, comprising a cam ring 12, radial cylinders 15 disposed in the inner part 16 inside the cam ring and pistons 13 that move therein as well as rollers 14 coupled to the pistons so as to follow the cam ring 12. The operation of the hydraulic motor 4 is based on conveying hydraulic oil or other such hydraulic medium to the cylinders 15 under the pistons 13 for moving the pistons 13 outward in the cylinders 15 so as to force the rollers 14 against the inner surface 12*a* of the cam ring 12. The hydraulic motor 4 has several cylinders 15, eight in the case of FIGS. 2 and 3, so that the rollers 14 of different pistons 13 contact the cam ring 12 at different points and stages of the wave-shaped inner surface 12*a* thereof, forcing the cam ring 12 and the inner part 16 to rotate relative to each other. In some situations, the hydraulic motor 4 must be couplable into freewheeling so that, as illustrated in FIG. 3, the rollers 14 of the pistons 13 come off the inner surface 12*a* of the cam ring 12 as the pressure is withdrawn from the cylinders 15 under the pistons 13. This can be carried out e.g. by the corresponding spring devices i.e. disengaging members coupled to the pistons 13 as described in U.S. Pat. No. 7,225,720 that is herein referred to regarding implementation of the mechanical spring devices.

As illustrated in FIG. 1, the hydraulic motor comprises three valves in the hydraulic circuit of the motor, i.e. a first valve 1, a second valve 2 and a third valve 3. The first valve 1 is a directional valve with four ports and two operating positions that is coupled to a working pressure line 5 leading to the hydraulic motor 4 and to a return line 6 provided from the motor. The first valve 1 is a pressure-controlled valve which is controlled via the working pressure line 5 through a choke 9. The pressure control channel is indicated with reference number 8 in FIG. 1.

The second valve 2 and the third valve 3 are directional valves with two ports and two operating positions (switched on/switch off position), coupled to a control pressure line 7. More specifically, the third valve 3 is coupled to a part 7' of the control pressure line 7. In addition, the second valve 2 is provided with check valve operation in the switched on position, so that, in the case of the second valve 2 in FIG. 1, hydraulic oil is able to flow in only one direction from the control pressure line 7 to the part 7' of the control pressure line 7. The above-mentioned check valve operation can be left out from FIG. 1 if said check valve operation is provided in connection with the second valve 2 in some other way.

The operation of the control coupling according to the hydraulic schematic shown in FIG. 1 can be briefly described as follows. By means of the control coupling, the hydraulic motor 4 automatically couples into freewheeling, so that the hydraulic motor 4 can be driven freely in the freewheeling state irrespective of whether the hydraulic oil supplied to the hydraulic motor 4 be available or not. When e.g. a working machine (not illustrated) or the like which is provided with the control coupling according to the invention is started from a slow speed while the hydraulic motor 4 is driving, the second valve 2 and the third valve 3 are disposed in the position illustrated in FIG. 1, where said valves 2, 3 close the control pressure line 7 in both directions. The first valve 1, instead, is disposed in its extreme position on the right in contrast to FIG. 1, in which position the working pressure line 5 and the return line 6, respectively, are directly connected to the hydraulic motor 4 through the first valve 1, so that the hydraulic oil circulates through the hydraulic motor 4 and the hydraulic motor 4 is driving. The first valve 1 is disposed in the extreme position on the right in contrast to FIG. 1 because it is pressure-controlled via the working pressure line 5 through a pressure control line 8 and a choice 9. In the working pressure line 5, the pressure is so high as to push the first valve 1 to its right extreme position. The purpose of the choke 9 in the case of FIG. 1 is to limit the amount of hydraulic oil supplied to the control pressure of the first valve 1 and make the pushing of the first valve 1 to its right extreme position smoother. If the first valve 1 already has a built-in choke 9 or the structure of the first valve 1 is provided such that the flow to the control pressure of the first valve 1 is limited, the choke 9 is not necessary and may be left out from FIG. 1.

If the hydraulic motor 4 was not provided with the control coupling illustrated in FIG. 1, as the speed would rise sufficiently high, the rollers 14 of the pistons 13 would start to come off the cam ring 12 and the hydraulic motor 4 would start to make as abnormal sound. When a motor starts to make this kind of a sound, there is obviously a risk of breakage. This is because, as the speed rises, the output supplied by the pump, i.e. the volume flow, is no longer sufficient at a certain point relative to the speed of the motor 4, in which case the pressure in the working pressure line 5 drops. It is characteristic of the hydraulic motor 4 that a certain supply pressure must be constantly available so as to keep the rollers 14 of the pistons 13 engaged to the wave-shaped inner surface 12*a* of the cam ring 12. However, by means of the control coupling according to FIG. 1, as the speed rises and the pressure in the working pressure line 5 drops below a specific level, the first valve 1 moves to the position illustrated in FIG. 1, i.e. to its extreme position on the left, so that the working pressure is no longer supplied to the hydraulic motor 4, but the motor 4 is instead disposed in a freewheeling state and is freewheelable. The structure of the hydraulic motor 4 must be such that, as the pressure is withdrawn from under the pistons 13, the rollers 14 of the pistons 13 automatically come off the inner surface 12*a* of the cam ring 12 and the motor is freewheeled. Such a freewheeling motor is described e.g. in FI patent publication 118233.

In the illustration of FIG. 1, the first valve 1 is such that the hydraulic oil is directly supplied from the working pressure line 5 to the return line 6 in the freewheeling state. Alternatively, the structure of the valve 1 may be such that the working pressure line 5 and the return line 6 are connected to the plug in the freewheeling state. This alternative is described with reference to the valve 1*c* of FIG. 5 and described in more detail with reference to FIG. 5. Further, FIG. 1 indicates by the dash line 10 that the first valve 1 is a component internal to the motor 4. However, the valve 1 may alternatively be provided outside the motor 4. Also the choke 9 may alternatively be provided outside the motor 4.

When the working mode of the hydraulic motor 4 is to be assumed from the freewheeling state illustrated in FIG. 1, the second valve 2 is moved from the position illustrated in FIG. 1 to its second position, i.e. to the extreme position on the right. In this case, the control pressure is able to act from the control pressure line 7 through said second valve 2 on the first value 1 so as to push it from the position illustrated in FIG. 1 to the right. In this position, the working pressure is able to move from the working pressure line 5 to the motor 4. By using the second valve 2, the hydraulic motor 4 can thus be forced into the working mode, i.e. to drive irrespective of the rotating speed or pressure. In other words, the hydraulic motor 4 can be started by pressing on the button of the valve 2. In the illustration of FIG. 1, the second valve 2 is controlled, by a button against a spring. Thus, when said valve 2 has been operated and the motor 4 brought into the working mode, the second valve 2 returns to the position illustrated in FIG. 1 as the button is released. Alternatively, said button may also be implemented e.g. by electromagnetic control, pneumatic control or other control that carries out the change of the operating position of said valve.

The third valve 3, in turn, is used for forcing the hydraulic motor 4 into freewheeling irrespective of the rotating speed or pressure. Once the motor 4 is provided in the working mode, the first valve 1 is disposed in the extreme position on the right in contrast to FIG. 1. To bring the hydraulic motor 4 into freewheeling, the third valve 3 is operated so as to move it from the position illustrated in FIG. 1 to the right. In this case, a connection is formed between the part 7' of the control pressure line 7 and a line 11 that leads to the tank. The control pressure is thereby withdrawn from the first valve 1 and it moves back to the position illustrated in FIG. 1 where the hydraulic motor 4 is provided in the freewheeling state. In the illustration of FIG. 1, the third valve 3 is provided with electromagnetic control against a spring. The control may also be implemented by a button, pneumatic control or other such manner by which the change of the operating position is established.

The above-described second valve 2 and third valve 3 can alternatively be combined into one valve so as to provide in said combined valve the same operation as described above with reference to the second valve 2 and the third valve 3, so it is not explained in any more detail in the figures.

Figure 4:
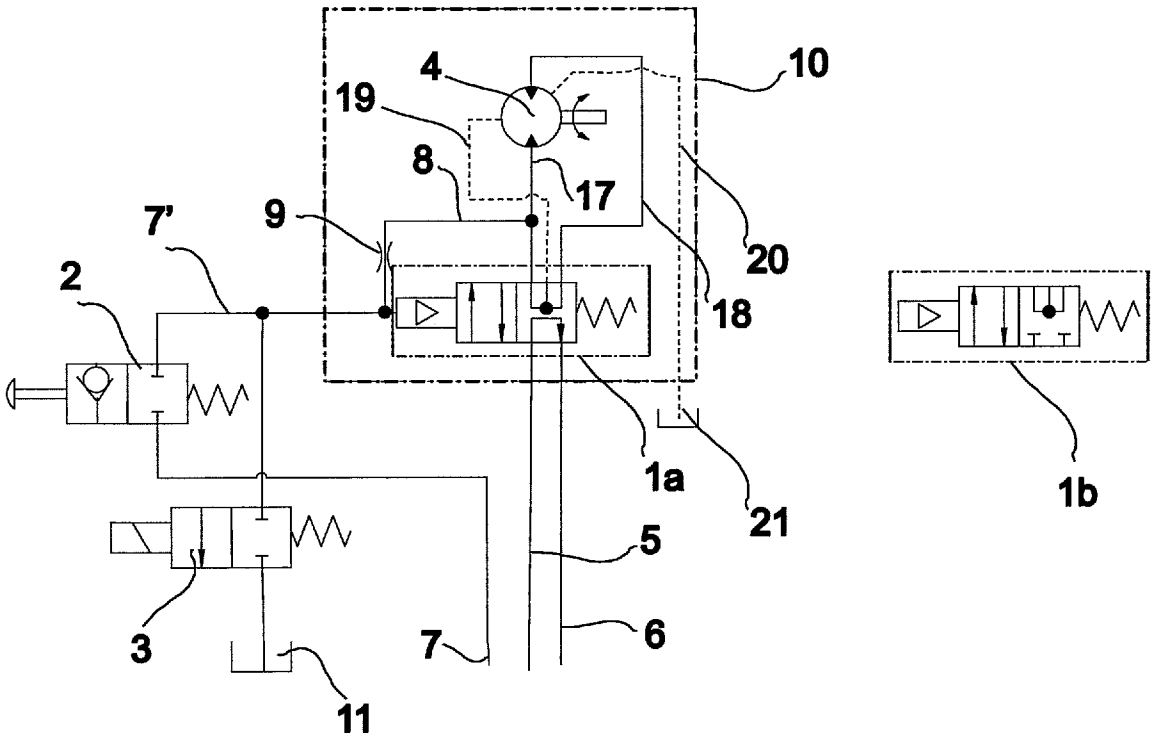
FIG. 4 shows another alternative simplified hydraulic schematic of the radial piston hydraulic motor with the control coupling.

FIG. 4 shows another alternative hydraulic schematic of the hydraulic motor with the control coupling. The hydraulic motor 4 of FIG. 4 with the control coupling operates as described above with reference to FIG. 1 with the exception that, in the illustration of FIG. 4, the hydraulic motor comprises a case line 19, an inlet line 17 and an outlet line 18 of the hydraulic motor 4 so that, when the pressure of hydraulic oil drops below a specific level, the valve 1*a* or 1*b* is arranged to connect, by means of hydraulic oil, the inlet line 17 and the outlet line 18 of the hydraulic motor 4 to each other and to connect the inlet line 17 and the outlet line 18 to the case line 19 of the hydraulic motor 4 through the valve 1*a* or 1*b*. The working pressure line 5 comprises the inlet line 17 provided between the valve 1*a* or 1*b* and the hydraulic motor 4. The return line 6 comprises the outlet line 18 provided between the valve 1*a* or 1*b* and the hydraulic motor 4. In addition, the hydraulic motor also comprises a drain line 20 and a tank line 21, wherein the case line 19 is connected, through the hydraulic motor 4, to the drain line 20 which is coupled to the tank line 21. In addition, when the pressure of hydraulic oil in the working pressure line 5 drops below a specific level, the first valve 1*a* connects the working pressure line 5 to the return line 6 or, in the case of the valve 1*b*, closes the pressure line 5 to the valve 1*b*. In the hydraulic schematic according to FIG. 4, the discharge of hydraulic oil, which controls the pistons, from under the pistons into the tank line 21 and the coupling to the freewheeling state by the hydraulic motor 4 may be accelerated. The purpose of the choke 9 in the case of FIG. 4 is the same as described earlier with reference to FIG. 1 i.e. is to limit the amount of hydraulic oil supplied to the control pressure of the first valve 1*a* or 1*b* and make the pushing of the first valve 1*a* or 1*b* to its right extreme position smoother. If the first valve 1*a* or 1*b* already has a built-in choke 9 or the structure of the first valve 1*a* or 1*b* is provided such that the flow to the control pressure of the first valve 1*a* or 1*b* is limited, the choke 9 is not necessary and may be left out from FIG. 4.

The hydraulic schematic of FIG. 5 illustrates alternative solutions to the first valve 1 illustrated in FIG. 1. The hydraulic motor of FIG. 5 operates as described above with reference to FIG. 1 with the exception that alternative valve structures 1*c*, 1*d*, 1*e* and 1*f* to the first valve 1 are illustrated. The purpose of the choke 9 in the case of FIG. 5 is the same as described earlier with reference to FIG. 1 i.e. is to limit the amount of hydraulic oil supplied to the control pressure of the first valve 1*c*-1*f* and make the pushing of the first valve 1*c*-1*f* to its right extreme position smoother. If the first valve 1*c*-1*f* already has a built-in choke 9 or the structure of the first valve 1*c*-1*f* is provided such that the flow to the control pressure of the first valve 1*c*-1*f* is limited, the choke 9 is not necessary and may be left out from FIG. 5.

The control coupling of FIG. 5 comprises the first valve 1*c* operating as described with reference to FIG. 1 with the exception that, when the prevailing pressure of hydraulic fluid in the working pressure line drops below a specific level, the first valve 1*c* closes the working pressure line and the return line to the hydraulic motor and to the first valve 1*c*.

The control coupling of FIG. 5 comprises the first valve 1*d* operating as described with reference to FIG. 1 with the following exception: the working pressure line 5 comprises the inlet line 17 of the hydraulic motor 4 provided between the first valve 1*d* and the hydraulic motor 4 and the return line 6 comprises the outlet line 18 of the hydraulic motor 4 provided between the first valve 1*d* and the hydraulic motor; when the prevailing pressure of hydraulic oil in the working pressure line 5 drops below a specific level, the first valve 1*d* closes the working pressure line 5 and the return line 6 to the first valve 1*d* and connects the inlet line 17 and the outlet line 18 to each other through the first valve 1*d*.

The control coupling of FIG. 5 comprises the first valve 1*e* operating as described with reference to FIG. 1 with the following exception: the working pressure line 5 comprises the inlet line 17 of the hydraulic motor 4 provided between the first valve 1*e* and the hydraulic motor 4 and the return line 6 comprises the outlet line 18 of the hydraulic motor 4 provided between the first valve 1*e* and the hydraulic motor; when the prevailing pressure of hydraulic oil in the working pressure line 5 drops below a specific level, the first valve 1*e* closes the working pressure line 5 and the return line 6 to the hydraulic motor 4 and connects the inlet line 17 and the outlet line 18 to each other through the valve 1*e*, in which case the hydraulic oil is conveyed from the working pressure line 5 directly to the return line 6.

The control coupling of FIG. 5 comprises the first valve 1*f* operating as described with reference to FIG. 1 with the following exception: the working pressure line 5 comprises the inlet line 17 of the hydraulic motor 4 provided between the first valve 1*f* and the hydraulic motor 4 and the return line 6 comprises the outlet line 18 of the hydraulic motor 4 provided between the first valve 1*f* and the hydraulic motor; when the prevailing pressure of hydraulic oil in the working pressure line 5 drops below a specific level, the first valve 1*f* closes the working pressure line 5 to the hydraulic motor and connects the inlet line 17 and the outlet line 18 to the return line 6 through the first valve 1*f*.

The hydraulic motor with the control coupling has been exemplified above with reference to the accompanying figures. However, the scope of protection of the invention is not limited merely to the examples illustrated in the figures; instead, the embodiments of the invention may vary within the scope of the inventive idea defined in the accompanying claims.

The invention claimed is:

1. A radial piston hydraulic motor comprising a cam ring provided with a wave-shaped inner surface and radial cylinders disposed in the inner part inside the cam ring and pistons that move therein as well as rollers coupled to the pistons so as to follow the inner surface of the cam ring in order that, by the effect of the working pressure of hydraulic oil conveyed to the cylinders, the rollers that are pressed against the inner surface of the cam ring provide a rotating movement of the cam ring and the inner part relative to each other, and the hydraulic motor being provided with disengaging members which disengage the rollers coupled to the pistons from contact to the inner surface of the cam ring when the working pressure stops acting in the cylinders for bringing the hydraulic motor into freewheeling, wherein the hydraulic motor is provided with a control coupling which, when the prevailing pressure of hydraulic oil in a working pressure line that leads to the cylinders drops below a specific level, automatically disengages the cylinders from the working pressure line and couples the hydraulic motor into freewheeling.

2. The radial piston hydraulic motor according to claim 1, wherein the control coupling comprises a first valve which is a pressure-controlled valve that is coupled to the working pressure line leading to the cylinders of the hydraulic motor and to a return line provided from the cylinders, respectively, and which is controlled via the working pressure line so that, when the prevailing pressure of hydraulic oil in the working pressure line drops below a specific level, the first valve closes the working pressure line and the return line to the hydraulic motor.

3. The radial piston hydraulic motor according to claim 2, wherein the first valve is a component internal to the hydraulic motor.

4. The radial piston hydraulic motor according to claim 2, wherein the first valve is a component external to the hydraulic motor.

5. The radial piston hydraulic motor according to claim 2, wherein the hydraulic motor comprises a control pressure line, wherein the control coupling of the hydraulic motor comprises a separately operated second valve coupled to the control pressure line that leads to the first valve for forcing a working mode of the hydraulic motor that has been coupled or that is coupling into freewheeling irrespective of the rotating speed or working pressure.

6. The radial piston hydraulic motor according to claim 5, wherein the control pressure line comprises the part, wherein the control coupling of the hydraulic motor further comprises the separately operated third valve coupled to the part of the control pressure line of the first valve for forcing the hydraulic motor from the working mode into freewheeling irrespective of the rotating speed or working pressure.

7. The radial piston hydraulic motor according to claim 2, wherein the hydraulic motor comprises the control pressure line and the control pressure line comprises a part, wherein the control coupling of the hydraulic motor further comprises a separately operated third valve coupled to the part of the control pressure line of the first valve for forcing the hydraulic motor from the working mode into freewheeling irrespective of the rotating speed or working pressure.

8. The radial piston hydraulic motor according to claim 2, wherein the hydraulic motor comprises a case line, an inlet line and an outlet line so that, when the prevailing pressure of hydraulic oil in the working pressure line drops below a specific level, the first valve is arranged to connect, by means of hydraulic oil, the inlet line and the outlet line of the hydraulic motor to each other and to connect the inlet line and the outlet line to the case line of the hydraulic motor through the first valve.

9. The radial piston hydraulic motor according to claim 8, wherein the hydraulic motor comprises a drain line and a tank line, the case line being connected through the hydraulic motor to the drain line which is coupled to the tank line.

10. The radial piston hydraulic motor according to claim 9, wherein the control coupling is provided with the choke through which the first valve is controlled via the working pressure line.

11. The radial piston hydraulic motor according to claim 8, wherein the control coupling is provided with the choke through which the first valve is controlled via the working pressure line.

12. The racial piston hydraulic motor according to claim 2, wherein the control coupling is provided with a choke through which the first valve is controlled via the working pressure line.

13. The radial piston hydraulic motor according to claim 1, wherein the control coupling comprises the first valve which is a pressure-controlled valve that is coupled to the working pressure line leading to the cylinders of the hydraulic motor and to the return line provided from the cylinders, respectively, and which is controlled via the working pressure line so that, when the prevailing pressure of hydraulic oil in the working pressure line drops below a specific level, the first valve closes the working pressure line and the return line to the hydraulic motor, in which case the hydraulic oil is conveyed from the working pressure line directly to the return line.

14. The radial piston hydraulic motor according to claim 13, wherein the hydraulic motor comprises the case line, the inlet line and the outlet line so that, when the prevailing pressure of hydraulic oil in the working pressure line drops below a specific level, the first valve is arranged to connect, by means of hydraulic oil, the inlet line and the outlet line of the hydraulic motor to each other and to connect the inlet line and the outlet line to the case line of the hydraulic motor through the first valve.

15. The radial piston hydraulic motor according to claim 14, wherein the hydraulic motor comprises the drain line and the tank line, the case line being connected through the hydraulic motor to the drain line which is coupled to the tank line.

16. The radial piston hydraulic motor according to claim 15, wherein the control coupling is provided with the choke through which the first valve is controlled via the working pressure line.

17. The radial piston hydraulic motor according to claim 14, wherein the control coupling is provided with the choke through which the first valve is controlled via the working pressure line.

18. The radial piston hydraulic motor according to claim 13, wherein the control coupling is provided with the choke through which the first valve is controlled via the working pressure line.

19. The radial piston hydraulic motor according to claim 1, wherein the disengaging members provided in the hydraulic motor are mechanical spring devices.

* * * * *